US011617696B2

(12) United States Patent
Jähkel

(10) Patent No.: US 11,617,696 B2
(45) Date of Patent: Apr. 4, 2023

(54) MOBILITY DEVICE

(71) Applicant: PERMOBIL AB, Timrå (SE)

(72) Inventor: Jonas Jähkel, Stockholm (SE)

(73) Assignee: PERMOBIL AB, Timrå (SE)

( * ) Notice: Subject to any disclaimer, the term of this patent is extended or adjusted under 35 U.S.C. 154(b) by 0 days.

(21) Appl. No.: 15/733,865

(22) PCT Filed: Jul. 18, 2019

(86) PCT No.: PCT/EP2019/069375
§ 371 (c)(1),
(2) Date: Nov. 30, 2020

(87) PCT Pub. No.: WO2020/016359
PCT Pub. Date: Jan. 23, 2020

(65) Prior Publication Data

US 2021/0346217 A1 Nov. 11, 2021

(30) Foreign Application Priority Data

Jul. 19, 2018 (EP) ..... 18184496

(51) Int. Cl.
*A61G 5/00* (2006.01)
*A61G 5/10* (2006.01)
(Continued)

(52) U.S. Cl.
CPC ..... *A61G 5/1056* (2013.01); *A61G 5/041* (2013.01); *A61G 5/122* (2016.11); *A61G 5/127* (2016.11)

(58) Field of Classification Search
CPC ..... A61G 5/1056; A61G 5/122; A61G 5/127; A61G 5/041
(Continued)

(56) References Cited

U.S. PATENT DOCUMENTS 4,456,086 A 6/1984 Wier et al.
5,011,175 A 4/1991 Nicholson et al.
(Continued)

FOREIGN PATENT DOCUMENTS

CA 2083042 A1 11/1991
CN 106691719 A 5/2017
(Continued)

OTHER PUBLICATIONS

International Preliminary Report on Patentability for Application No. PCT/EP2019/069375 dated Jan. 19, 2021 (6 pages).
(Continued)

*Primary Examiner* — John D Walters
*Assistant Examiner* — Hilary L Johns
(74) *Attorney, Agent, or Firm* — Michael Best & Friedrich LLP

(57) ABSTRACT

A mobility device (1) comprising: a main frame (3) having a central longitudinal axis which coincides with the median plane of the mobility device (1), an elongated body support member (13*b*) which has a central longitudinal axis (At) that is contained in a median plane of the mobility device (1), the body support member (13*b*) being pivotally connected to the main frame (3) via a medial pivot connection (17), and an elongated rotation transfer member (13*c*) rotatably connected to the body support member (13*b*), wherein the rotation transfer member (13*b*) has a central longitudinal axis (A2) which extends transversally relative to the central longitudinal axis (At) of the body support member (13*b*).

19 Claims, 5 Drawing Sheets

(51) Int. Cl.
*A61G 5/12* (2006.01)
*A61G 5/04* (2013.01)

(58) Field of Classification Search
USPC ..... 180/210
See application file for complete search history.

(56) References Cited

U.S. PATENT DOCUMENTS

| | | | | |
|---|---|---|---|---|
| 5,046,571 | A | 9/1991 | Kullerud | |
| 5,297,021 | A | 3/1994 | Koerlin et al. | |
| 5,515,934 | A | 5/1996 | Davis | |
| 5,975,225 | A | 11/1999 | Kamen et al. | |
| 6,112,843 | A | 9/2000 | Wilcox et al. | |
| 6,311,795 | B1 | 11/2001 | Skotnikov et al. | |
| 7,004,271 | B1 | 2/2006 | Kamen et al. | |
| 7,419,176 | B2 | 9/2008 | Perk | |
| 7,426,970 | B2 * | 9/2008 | Olsen | B60K 7/0007 180/908 |
| 7,717,200 | B2 | 5/2010 | Kakinuma et al. | |
| 7,766,106 | B2 | 8/2010 | Puskar-Pasewicz et al. | |
| 7,784,815 | B2 * | 8/2010 | Porcheron | A61G 5/128 280/47.38 |
| 8,474,848 | B2 | 7/2013 | Bernatsky et al. | |
| 8,596,719 | B2 | 12/2013 | Engman et al. | |
| 9,173,792 | B2 | 11/2015 | Goffer | |
| 9,278,036 | B2 | 3/2016 | Lee | |
| 9,375,372 | B2 * | 6/2016 | Hunziker | A61G 5/1056 |
| 9,452,096 | B2 | 9/2016 | Jahkel et al. | |
| 9,511,811 | B2 | 12/2016 | Andreev | |
| 10,028,870 | B2 | 7/2018 | Olsson | |
| 10,719,085 | B2 * | 7/2020 | Perkins | B25J 9/162 |
| 10,772,774 | B2 | 9/2020 | Richter | |
| 2002/0121394 | A1 | 9/2002 | Karmen et al. | |
| 2004/0262055 | A1 | 12/2004 | Bancroft | |
| 2007/0102615 | A1 | 5/2007 | Engman | |
| 2007/0152427 | A1 * | 7/2007 | Olsen | B60L 15/20 280/649 |
| 2009/0267315 | A1 | 10/2009 | Suddaby et al. | |
| 2013/0278032 | A1 * | 10/2013 | Hunziker | A61G 5/1067 297/340 |
| 2015/0053490 | A1 | 2/2015 | Santagata | |
| 2017/0071804 | A1 | 3/2017 | Olsson | |
| 2019/0046373 | A1 | 2/2019 | Coulter et al. | |

FOREIGN PATENT DOCUMENTS

| | | | |
|---|---|---|---|
| CN | 107049631 | A | 8/2017 |
| CN | 107361934 | A | 11/2017 |
| CN | 107595502 | A | 1/2018 |
| CN | 206852718 | U | 1/2018 |
| DE | 19933052 | C1 | 11/2000 |
| DE | 19933053 | A1 | 2/2001 |
| DE | 202007018454 | U1 | 7/2008 |
| EP | 1738734 | A2 | 1/2007 |
| EP | 1997466 | A2 | 12/2008 |
| EP | 3245994 | A1 | 11/2017 |
| FR | 3066692 | A3 | 11/2018 |
| GB | 2548917 | A | 10/2017 |
| JP | 2004275486 | A | 10/2004 |
| WO | 9728775 | A1 | 8/1997 |
| WO | 9744206 | A1 | 11/1997 |
| WO | 2016181173 | A1 | 11/2016 |
| WO | 2017201513 | A1 | 11/2017 |

OTHER PUBLICATIONS

International Search Report and Written Opinion for Application No. PCT/EP2019/069376 dated Oct. 1, 2019 (13 pages).
International Preliminary Report on Patentability for Application No. PCT/EP2019/069373 dated Jun. 19, 2020 (12 pages).
International Search Report and Written Opinion for Application No. PCT/EP2019/069373 dated Oct. 7, 2019 (14 pages).
International Search Report and Written Opinion for Application No. PCT/EP2019/069375 dated Oct. 18, 2019 (12 pages).
Australian Patent Office Examination Report No. 1 for Application No. 2019304043 dated Jun. 30, 2021 (3 pages).
China National Intellectual Property Administration First Office Action for Application No. 201980040358.8 dated Jul. 5, 2022 (18 pages including English translation).
European Patent Office Examination Report for Application No. 19745577.7 dated Aug. 16, 2022 (5 pages).
Canadian Patent Office Action for Application No. 3,106,769 dated Apr. 5, 2022 (4 pages).
Taiwanese Patent Office Action for Related Application No. 108125457 dated Jan. 6, 2023 (6 pages, including an English statement of relevance).

* cited by examiner

MOBILITY DEVICE

CROSS REFERENCE TO RELATED APPLICATIONS

This application is a national phase filing of International Patent Application No. PCT/EP2019/069375, entitled "MOBILITY DEVICE" and filed on Jul. 18, 2019, which claims priority to European Patent Application No. 18184496.0 entitled "MOBILITY DEVICE" and filed on Jul. 19, 2018, the entire contents of each application is herein incorporated by reference in its entirety.

TECHNICAL FIELD

The present disclosure generally relates to mobility devices.

BACKGROUND

Mobility devices such as wheelchairs typically have a chassis on which the seating system is arranged and from which the wheels are suspended. The seating system includes the seat, the backrest and the armrests.

Typically, the position of the backrest may be set by means of an actuating device. The chassis is generally bulky, since it among other things contains the large battery pack, which is centrally arranged. Moreover, there are requirements on a certain amount of ground clearance, while at the same time the seat height should be as low as possible. Additionally, a tilt/lift system for the seating system may be arranged centrally. Due to these circumstances, the actuating device is normally arranged laterally on one side of the chassis. Since force has to be transmitted from one side to control the backrest, the backrest is generally designed to have a very high torsional stiffness in order to withstand this force. As a result, the physical dimension and weight of the wheelchair is adversely affected. Additionally, the force transfer from one side to the backrest provides complexity to the wheelchair.

SUMMARY

In view of the above, a general object of the present disclosure is to provide a mobility device which solves or at least mitigates the problems of the prior art.

There is hence provided a mobility device comprising: a main frame, an elongated body support member which has a central longitudinal axis that is contained in a median plane of the mobility device, the body support member being pivotally connected to the main frame via a medial pivot connection, and an elongated rotation transfer member configured to rotate relative to the body support member via a medial connection, wherein the rotation transfer member has a central longitudinal axis which extends transversally relative to the central longitudinal axis of the body support member.

By means of this configuration symmetrical force transfer from a medial location to bilateral locations by means of the rotation transfer member may be enabled. Hence, a mobility device with lower torsional stiffness requirements may be provided. The size, weight and complexity of the mobility device may thereby be reduced.

The main frame may have an elongated shape. The main frame may have a central longitudinal axis which coincides with the median plane, i.e. the mid-sagittal plane, of the mobility device.

The rotation transfer member may extend transversely through the body support member.

According to one embodiment the body support member and the rotation transfer member have the shape of a T, with the body support member forming the base of the T and the rotation transfer member forming the top of the T.

One embodiment comprises a first lateral motion transfer member fixedly connected to the rotation transfer member at a first lateral end thereof, and a second lateral motion transfer member fixedly connected to the rotation transfer member at a second lateral end thereof.

The first lateral motion transfer member may be rotationally fixed relative to the rotation transfer member.

The second lateral motion transfer member may be rotationally fixed relative to the rotation transfer member.

Rotation of the rotation transfer member may hence cause rotation or pivoting—depending on the particular implementation—of the first lateral motion transfer member and the second lateral motion transfer member.

One embodiment comprises a backrest, an elongated first support structure extending between a first end of the rotation transfer member and the backrest, a first backrest rotational drive member interconnected with the first lateral motion transfer member and fixedly connected to the backrest, an elongated second support structure extending between a second end of the rotation transfer member and the backrest, and a second backrest rotational drive member interconnected with the second lateral motion transfer member and fixedly connected to the backrest, wherein rotation of the rotation transfer member causes the first lateral motion transfer member, the first backrest rotational drive member to rotate, the second lateral motion transfer member to rotate, and the second backrest rotational drive member to rotate, thereby rotating the backrest.

According to one embodiment the first support structure is configured to space apart the first backrest rotational drive member and the first lateral motion transfer member, and the second support structure is configured to space apart the second backrest rotational drive member and the second lateral motion transfer member.

One embodiment comprises a leg rest pivotally connected to the main frame via said medial pivot connection wherein the rotation transfer member has a rotation transfer connection with the leg rest, whereby rotational motion of the leg rest relative to the main frame causes rotation of the rotation transfer member providing corresponding rotational motion of the first lateral motion transfer member and the second lateral motion transfer member.

Thus, power transfer from a medial location may be provided bilaterally to the first lateral motion transfer member and to the second lateral motion transfer member.

One embodiment comprises a leg rest actuating device configured to control a leg rest pivot angle between the leg rest and the main frame.

According to one embodiment the leg rest and the rotation transfer member form part of a symmetric rotation transfer assembly.

One embodiment comprises a first rotational drive member fixedly connected to leg rest.

The first rotational drive member may be rotationally fixed to the rotation transfer member.

The first rotational drive member may be a first sprocket or a first friction drive wheel.

One embodiment comprises a second rotational drive member fixedly connected to the rotation transfer member.

The second rotational drive member may be a second sprocket or a second friction drive wheel.

The second rotational drive member may be rotationally fixed to the leg rest.

According to one embodiment the first lateral motion transfer member is a third rotational drive member and the second lateral motion transfer member is a fourth rotational drive member.

The third rotational drive member may be a third sprocket or a third friction drive wheel.

The fourth rotational drive member may be a fourth sprocket or a fourth friction drive wheel.

The first rotational drive member and the second rotational drive member may be designed so that the third rotational drive member and the fourth rotational drive member are rotated the same amount as the amount of rotation of the leg rest.

The mobility device may comprise a backrest.

The backrest may be connected to the first lateral motion transfer member and to the second lateral motion transfer member such that rotational or pivot motion of the first lateral motion transfer member and the second lateral motion transfer member is transferred to the backrest.

The mobility device may comprise a first backrest rotational drive member which has a rotation transfer connection with the first lateral motion transfer member such that rotation of the first lateral motion transfer member causes rotation of the first backrest rotational drive member.

The first backrest rotational drive member may be a third sprocket or a third friction drive wheel.

The first backrest rotational drive member may be rotationally fixed to the backrest.

The first lateral motion transfer member and the first backrest rotational drive member may be interconnected by means of a chain or a belt.

The mobility device may comprise a second backrest rotational drive member which has a rotation transfer connection with the second lateral motion transfer member such that rotation of the second lateral motion transfer member causes rotation of the second backrest rotational drive member.

The second backrest rotational drive member may be a fourth sprocket or a fourth friction drive wheel.

The second backrest rotational drive member may be rotationally fixed to the backrest.

The second lateral motion transfer member and the second backrest rotational drive member may be interconnected by means of a chain or a belt.

The mobility device may comprise a first armrest and a second armrest fixedly connected relative to the backrest. The backrest, the first armrest and the second armrest may thus be pivoted concurrently with the same amount.

One embodiment comprises a belt system or a chain system interconnecting the first rotational drive member, the second rotational drive member, the third rotational drive member and the fourth rotational drive member to enable rotational motion transfer from the leg rest to the third rotational drive member and the to the fourth rotational drive member.

One embodiment comprises a linkage system interconnecting the leg rest, the rotation transfer member, the first lateral motion transfer member and the second lateral motion transfer member to enable rotational motion transfer from the leg rest to the first lateral motion transfer member and to the second lateral motion transfer member.

One embodiment comprises a body support actuating device pivotally connected to the main frame and to the body support member, wherein the body support actuating device is configured to control a body support member angle between the body support member and the main frame.

One embodiment comprises a control system configured to simultaneously control the leg rest actuating device and the body support actuating device.

According to one embodiment the control system is configured to control the leg rest actuating device and the body support actuating device to obtain a full standing position of the mobility device.

One embodiment comprises drive swing arms pivotally connected to the main frame, wheel motors, and drive wheels, each drive wheel being connected to a respective one of the drive swing arms and each drive wheel being configured to be driven by a respective wheel motor.

One embodiment comprises a rear wheel swing arm pivotally connected to the main frame, a rear wheel connected to the rear wheel swing arm, and a second actuating device configured to control a rear wheel swing arm angle between the rear wheel swing arm and the main frame independently of control of the wheel motors.

According to one embodiment the mobility device is a wheelchair or mobility aid device.

According to one embodiment the mobility device is a personal transporter or personal mobility device.

There is according to another aspect provided a mobility device comprising: a main frame, an elongated body support member which has a central longitudinal axis that is parallel with a median plane of the mobility device, the body support member being pivotally connected to the main frame via a medial pivot connection, and an elongated rotation transfer member configured to rotate relative to the body support member via a medial connection, wherein the rotation transfer member has a central longitudinal axis which extends transversally relative to the central longitudinal axis of the body support member, wherein the main frame has an elongated shape and having a central longitudinal axis which is arranged parallel with but offset from the median plane of the mobility device.

The central longitudinal axis of the main frame may be arranged in a sagittal plane of the mobility device.

According to one embodiment the central longitudinal axis of the body support member coincides with the median plane of the mobility device or it may be arranged offset from the median plane of the mobility device.

According to one embodiment, the central longitudinal axis of the body support is arranged offset in a first direction from the median plane of the mobility device and the central longitudinal axis of the main frame is arranged offset in a second direction from the median plane of the mobility device.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1:
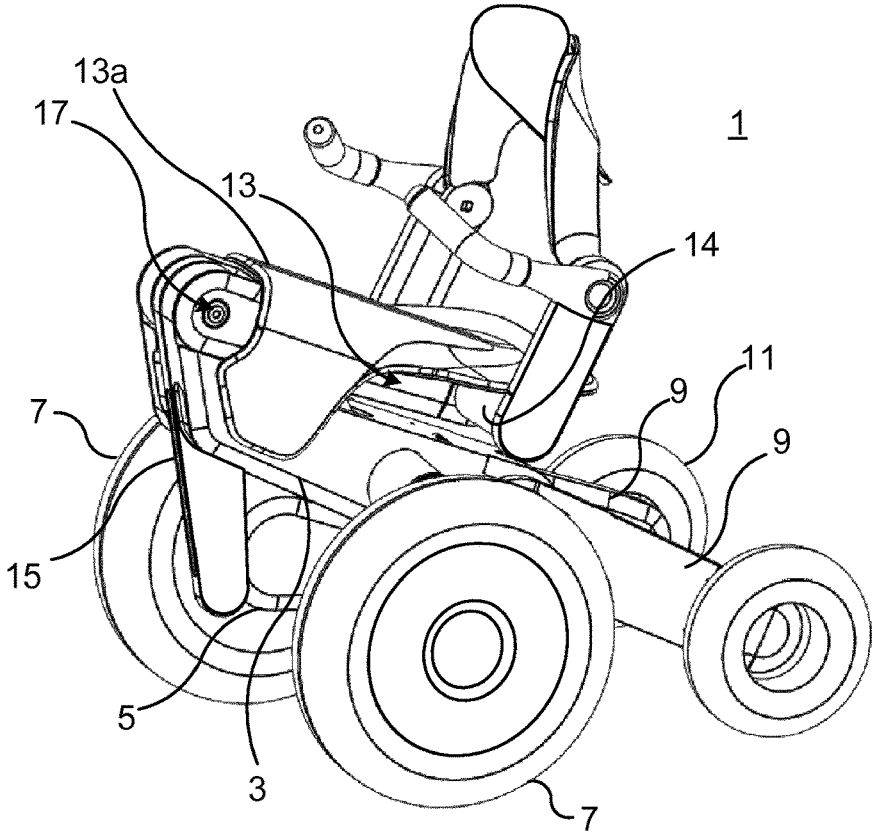
FIG. 1 schematically shows a perspective view of an example of a mobility device.

FIG. 1 shows a perspective view of an example of a mobility device 1. The mobility device 1 is shown in a first position. The mobility device 1 may be a mobility device for a disabled user. The mobility device 1 may in a sense be seen as a new type of wheelchair which replaces existing types of wheelchairs.

The mobility device 1 comprises a main frame 3, drive wheel swing arms 5, of which only one is visible, drive wheels 7, rear wheel swing arms 9, rear wheels 11, a body support system 13, and a leg rest 15.

The exemplified main frame 3 has an elongated shape. The main frame 3 is an essentially beam-like structure. The main frame 3 has a central longitudinal axis which coincides with the median plane, i.e. the mid-sagittal plane, of the mobility device 1.

The drive wheel swing arms 5 are pivotally connected to the main frame 3. Each drive wheel 7 is connected to a respective drive wheel swing arm 5. The mobility device 1 furthermore comprises wheel motors, not shown. Each wheel motor is configured to drive a respective drive wheel 7. Each wheel motor may for example be incorporated in a respective wheel hub. The mobility device 1 also comprises a control system which is configured to control the wheel motors.

The rear wheel swing arms 9 are pivotally connected to the main frame 3. In the present example, the mobility device 1 comprises two identical rear wheel swing arms, but could alternatively comprise a single rear wheel swing arm with a single rear wheel connected to it or with two rear wheels connected to it. The mobility device 1 may comprise a rear wheel arm actuating device, not shown, configured to control a rear wheel swing arm angle between the rear wheel swing arms 9 and the main frame 3 independently of control of the wheel motors.

The mobility device 1 furthermore comprises one or more batteries. The batteries are configured to drive the mobility device 1, e.g. to drive the wheel motors, leg rest actuating device, and body support member actuating device disclosed herein. The one or more batteries may for example be lithium batteries or lithium ion batteries, but any other battery type with similar power/volume unit performance is suitable for this purpose.

The body support system 13 is pivotally connected to the main frame 3 via a medial pivot connection 17. According to the example shown in FIG. 1, the body support system 13 comprises a seat 13*a*.

Figure 2:
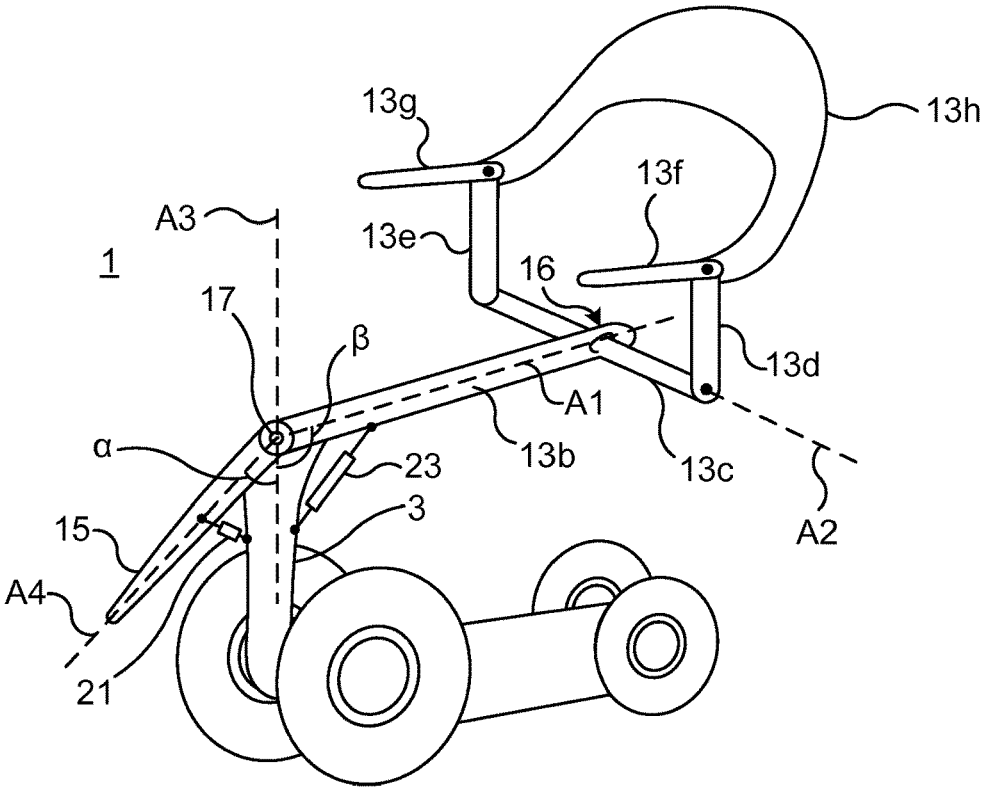
FIG. 2 schematically shows a perspective view of a simplified model of the mobility device in FIG. 1.

FIG. 2 schematically depicts a simplified model of the mobility device 1. The seat 13*a* has been removed to expose components of the body support system 13. The body support system 13 comprises an elongated body support member 13*b*, an elongated rotation transfer member 13*c*, an elongated first support structure 13*d* and an elongated second support structure 13*e*. The seat 13*a* is normally arranged on the body support member 13*b*. The body support system 13 further comprises a first armrest 13*f*, a second armrest 13*g* and a backrest 13*h*. The leg rest 15 may also form part of the body support system 13.

The first support structure 13*d* extends between a first end of the rotation transfer member 13*c* and the backrest 13*h*. The second support structure 13*e* extends between a second end of the rotation transfer member 13*c* and the backrest 13*h*. The rotation transfer member 13*c* may be contained in an elongated rotation transfer member housing 14, shown in FIG. 1. The first support structure 13*d* and the second support structure 13*e* may be fixedly connected to the rotation transfer member housing 14 shown in FIG. 1. The first support structure 13*d* and the second support structure 13*e* may be rotationally fixed relative to the rotation transfer member housing 14. The rotation transfer member housing 14 may also be rotationally fixed relative to the body support member 13*b*. This configuration will be elaborated upon in more detail with reference to FIGS. 7*a*-7*c*.

The body support member 13*b* may be an essentially beam-like structure. The body support member 13*b* has a central longitudinal axis A1 which coincides with the median plane of the mobility device 1. The body support member 13*b* is pivotally connected to the main frame 3 via the medial pivot connection 17. In particular, a first end portion of the body support member 13*b* is pivotally connected to the main frame 3 via the medial pivot connection 17. The body support member 13*b* hence extends longitudinally in a direction away from the medial pivot connection 17 in the median plane of the mobility device 1.

The rotation transfer member 13*c* is configured to rotate relative to the body support member 13*b*. The rotation transfer member 13*c* is hence able to rotate freely relative to the body support member 13*b*. The rotation transfer member 13*c* is rotatably connected relative to the body support member 13*b* and extends through the body support member 13*b* in a second end portion of the body support member 13*b*. The rotation transfer member 13*c* has a medial rotational connection 16 with the medial pivot connection 17. The body support member 13*b* and the rotation transfer member 13*c* form the shape of a T with the body support member 13*b* forming the base of the T and the rotation transfer member forming the top of the T.

The rotation transfer member 13*c* extends transversally with respect to the central longitudinal axis A1 of the body support member 13*b*. The rotation transfer member 13 has a central longitudinal axis A2 which intersects the central longitudinal axis A1 of the body support member 13*b* at a right angle.

The leg rest 15 may have an elongated shape. The leg rest 15 is pivotally connected to the main frame 3 via the same medial pivot connection 17 which pivotally connects the main frame 3 and the body support member 13*b*. The pivot connection between the leg rest 15 and the main frame 3, and the pivot connection between the body support member 13*b* and the main frame 3 are hence about the same pivot axis.

The exemplified mobility device 1 comprises a leg rest actuating device 21 pivotally connected to the main frame 3 and to the leg rest 15. The leg rest actuating device 21 is configured to control a pivot motion of the leg rest 15 relative to the main frame 3. The leg rest actuating device 21 is hence configured to control a leg rest pivot angle α between the leg rest 15 and the main frame 3. The leg rest pivot angle α may for example be the angle between central longitudinal axis A3 of the main frame 3 extending through the medial pivot connection 17, and a central longitudinal axis A4 of the leg rest 15. Alternatively, the leg rest pivot angle α may be for example be defined as the angle of the central longitudinal axis A4 of the leg rest 15 in a coordinate system of the main frame 3, which has its origin in the centre of the median pivot connection 17.

The exemplified mobility device 1 comprises a body support member actuating device 23. The body support actuating device 23 is pivotally connected to the main frame 3 and to the body support member 13*b*. The body support member actuating device 23 is configured to control a pivot motion of the body support member 13*b* relative to the main frame 3. The body support member actuating device 23 is hence configured to control a body support member angle β between the body support member 13*b* and the main frame 3. The body support member angle β may for example be the angle between the central longitudinal axis A3 of the main frame 3 extending through the medial pivot connection 17, and the central longitudinal axis A1 of the body support member 13*b*. Alternatively, the body support member angle β may for example be defined as the angle of the central longitudinal axis A1 of the body support member 13*b* in a coordinate system of the main frame 3, which has its origin in the centre of the median pivot connection 17.

The leg rest 15 is in a rotation transfer connection with the rotation transfer member 13*c*. Pivoting of the leg rest 15 by means of the leg rest actuating device 21 causes corresponding rotation of the rotation transfer member 13*c*. The leg rest 15 and the rotation transfer member 13*c* hence form part of a rotation transfer assembly which is symmetric. In particular, medial pivot motion of the leg rest 15 relative to the main frame 3 is transferred bilaterally by means of the rotation transfer member 13*c*.

The leg rest could alternatively be fixedly arranged to the main frame. The leg rest could for example comprise two leg supports which extend from the elongate body that forms the main frame.

Figure 3A:
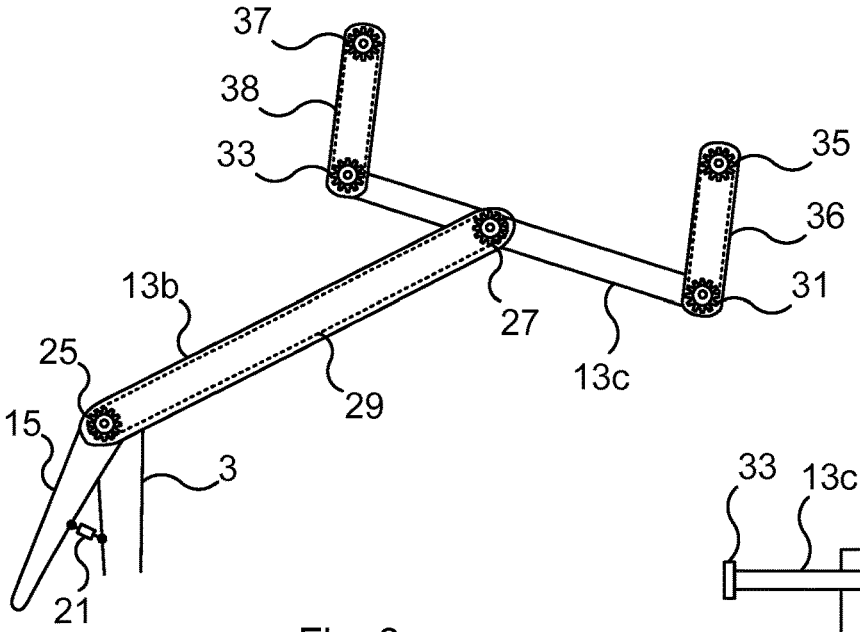
FIG. 3*a* schematically depicts a perspective view of an example of a symmetric rotation transfer assembly.
Figure 3B:
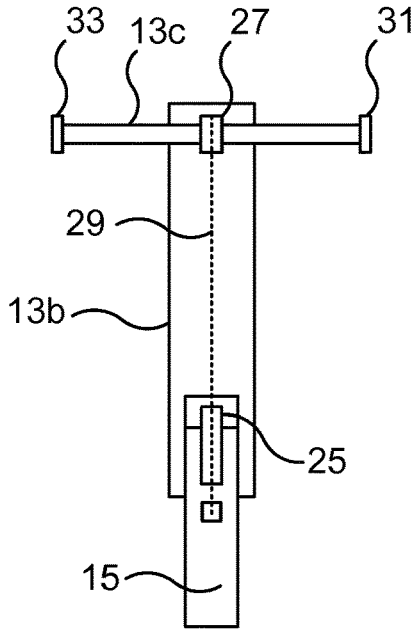
FIG. 3*b* shows a top view of the rotation transfer assembly in FIG. 3*a;*

FIGS. 3*a* and 3*b* show an example of a rotation transfer assembly for the mobility device 1. In this example, rotational motion transfer is provided by means of a chain or belt system connecting rotational drive members. The leg rest 15 is connected to the main frame 3 via the medial pivot connection 17. The leg rest 15 has a first rotational drive member 25. The first rotational drive member 25 is fixed to the leg rest 15. In particular, the first rotational drive member 25 is rotationally fixed relative to the leg rest 15. The first rotational drive member 25 may for example be a sprocket or a friction drive wheel.

The rotation transfer member 13*c* is in this example provided with a second rotational drive member 27. The second rotational drive member 27 is fixed to the rotation transfer member 13*c*. In particular, the second rotational drive member 25 is rotationally fixed relative to the rotation transfer member 13*c*. The second rotational drive member 27 may for example be a sprocket or a friction drive wheel.

The first rotational drive member 25 is interconnected with the second rotational drive member 27 such that rotation of the first rotational drive member 25 is transferred to the second rotational drive member 27. The first rotational drive member 25 may for example be interconnected with the second rotational drive member 27 by means of a chain, belt or similar means 29. In the case of a chain, the first and the second rotational drive members 25 and 27 may be sprockets, and in the case it is a belt, they may be friction drive wheels. The chain, belt or similar means may be arranged inside the body support member 13*b*.

In operation, when the leg rest 15 is pivoted by the leg rest actuating device 21, the first rotational drive member 25, which is fixed to the leg rest 15 causes movement of the chain, belt or similar means, which in turn causes the second rotational drive member 27 to rotate. This rotation is the same amount as the amount of pivoting of the leg rest 15. Since the second rotational drive member 27 is rotationally fixed to the rotation transfer member 13, the rotation transfer member 13*c* is also rotated.

In case of leg supports extending from the main frame, the first rotational drive member could be fixed to the main frame. Relative rotational movement between the main frame and the body support member would in this case cause movement of the chain, belt or similar means.

The rotation transfer assembly is in this example provided with a first lateral motion transfer member 31 fixed to the rotation transfer member 13*c* and a second lateral motion transfer member 33 fixed to the rotation transfer member 13*c*. The first lateral motion transfer member 31 is rotationally fixed to a first lateral end of the rotation transfer member 13*c* and the second lateral motion transfer member 33 is rotationally fixed to the second lateral end of the rotation transfer member 13*c*. The first lateral motion transfer member 31 is a third rotational drive member, for example a sprocket or a friction drive wheel. The second lateral motion transfer member 33 is a fourth rotational drive member, for example a sprocket or a friction drive wheel.

In FIG. 3*a* the interior of the first support structure 13*d* and the second support structure 13*e* is shown. The exemplified rotation transfer assembly comprises a first backrest rotational drive member 35 which is interconnected with the first lateral motion transfer member 31. These components may be contained in the first support structure 13*c*. The first backrest rotational drive member 35 may for example be a sprocket or a friction drive wheel. The first backrest rotational drive member 35 is interconnected with the first lateral motion transfer member 31 by means of a chain, belt or similar means 36. The first backrest rotational drive member 35 is fixedly connected to the backrest 13*h*. The first backrest rotational drive member 35 may in particular be rotationally fixed relative to the backrest 13*h*. Hence, when the rotation transfer member 13*c* is being rotated, the first lateral motion transfer member 31 is also rotated, causing the chain, belt or similar means 36 connecting the first lateral motion transfer member 31 and the first backrest rotational drive member 35 to move. The first backrest rotational drive member 35 is hence rotated.

The rotation transfer assembly also comprises a second backrest rotational drive member 37 which is interconnected with the second lateral motion transfer member 33. These components may be contained in the second support structure 13*e*. The second backrest rotational drive member 37 may be a sprocket or a friction drive wheel. The second backrest rotational drive member 37 is interconnected with the second lateral motion transfer member 33 by means of a chain, belt or similar means 38. The second backrest rotational drive member 37 is fixedly connected to the backrest 13*h*. The second backrest rotational drive member 37 may in particular be rotationally fixed relative to the backrest 13*h*. Hence, when the rotation transfer member 13*c* is being rotated, the second lateral motion transfer member 33 is also rotated, causing the chain, belt or similar means 38 connecting the second lateral motion transfer member 33 and the second backrest rotational drive member 37 to move. The second backrest rotational drive member 37 is hence rotated.

Since the first backrest rotational drive member 35 is fixed to the backrest 13*h* and the second backrest rotational drive member 37 is fixed to the backrest 13*h*, the backrest 13*h* is also rotated.

Figure 4:
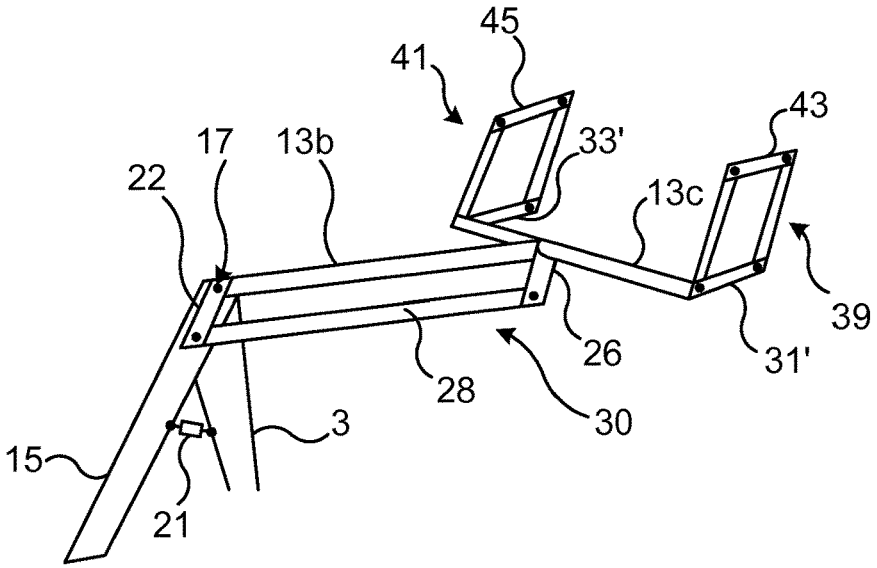
FIG. 4 shows another example of a symmetric rotation transfer assembly.

FIG. 4 shows another example of a rotation transfer assembly for the mobility device 1. In this example, the rotational motion transfer is provided by means of a linkage system 30. The leg rest 15 is connected to the main frame 3 via the medial pivot connection 17. The body support member 13*b* is pivotally connected to the main frame 3 via the medial pivot connection 17. The linkage system 30 includes a first link member 22 pivotally connected to the main frame 3 via the medial pivot connection 17. The first link member 22 may in particular have one end which is pivotally connected to the main frame 3 via the medial pivot connection 17. The first link member 22 extends along the leg rest 15, preferably along the median plane of the mobility device 1, and is pivotally connected to the leg rest 15 at a second end of the first link member 22. The linkage system 30 comprises a second link member 26 having a longitudinal extension along the medial plane of the mobility device 1, and which is fixedly connected to the rotation transfer member 13*c* at a first end of the second link member 26. The linkage system 30 also comprises a third link member 28 extending parallel with the body support member 13*b* and which at one end is connected to the second end of the second link member 26. The third link member 28 is connected to the first link member 22 at its other end, such that a parallelogram is formed by the body support member 13*b*, the first link member 22, the second link member 26 and the third link member 28. Thus, when the leg rest 15 is pivoted by the leg rest actuating device 21 the first link member 22 is pivoted about the medial pivot connection 17, causing the third link member 28 to move. The second link member 26 is thereby moved, causing rotation of the rotation transfer member 13*c*.

The exemplified linkage system 30 furthermore has a first lateral motion transfer member 31' fixedly connected to a first lateral end of the motion transfer member 13*c*. The first lateral motion transfer member 31' is hence rotationally fixed relative to the motion transfer member 13*c*. The first lateral motion transfer member 31' is a fourth linkage member. The fourth linkage member forms part of a first lateral sub-linkage 39 forming a parallelogram. The backrest 13*h* may be fixedly connected to sixth linkage member 43 of the first lateral sub-linkage 39. The first lateral sub-linkage 39 may for example be contained in the first support structure 13.

The linkage system 30 has a second lateral motion transfer member 33' fixedly connected to a second lateral end of the motion transfer member 13*c*. The second lateral motion transfer member 33' is hence rotationally fixed relative to the motion transfer member 13*c*. The second lateral motion transfer member 33' is a fifth linkage member. The fifth linkage member forms part of a second lateral sub-linkage 41 forming a parallelogram. The backrest 13*h* may be fixedly connected to seventh linkage member 45 of the second lateral sub-linkage 41.

In operation, when the rotation transfer member 13*c* is being rotated due to interaction with the leg rest 15 which is being pivoted, the first lateral motion transfer member 31' and the second lateral motion transfer member 33' follow the rotation of the rotation transfer member 13*c*, causing a change in the configuration of the parallelograms of the first lateral sub-linkage 39 and the second lateral sub-linkage 41. The backrest 13*h* will thereby be pivoted with the same amount as the pivot motion of the leg rest 15, which may be an angle Aa of the leg rest pivot angle $\alpha$.

In a variation of the examples described above, the first armrest 13*f* and the second armrest 13*g* may also be moved concurrently with the backrest 13*h*. The two armrests 13*f* and 13*g* may hence according to this example be fixed relative to the backrest 13*h*. The first armrest 13*f* and the second armrest 13*g* are thereby subjected to the same rotation or pivoting as the backrest 13*h* when the leg rest 15 is being pivoted.

Figure 5:
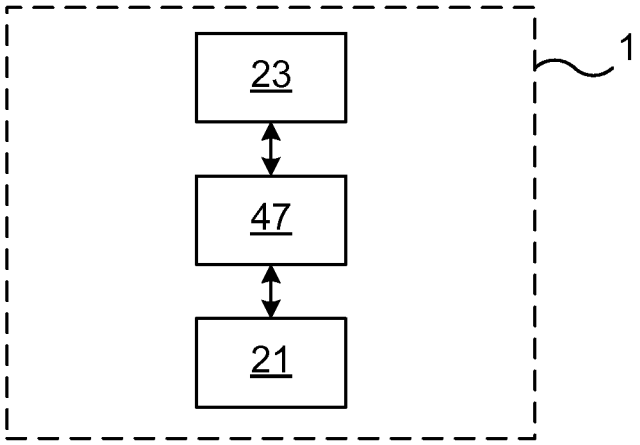
FIG. 5 is a block diagram of components of a mobility device.
Figure 6A:
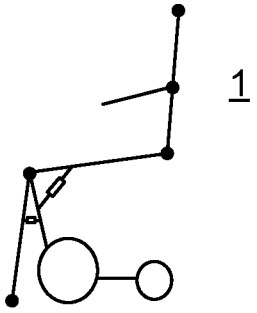
FIGS. 6*a*-6*c* schematically shows various positions which the mobility device may obtain.
Figure 6B:
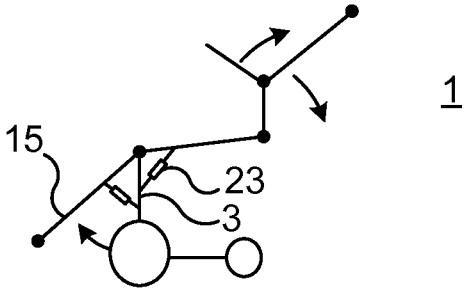
Figure 6C:
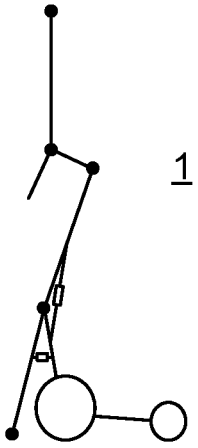

FIG. 5 shows a block diagram of certain components related to the control of the mobility device 1. The mobility device 1 may in particular comprise a control system 47. The control system 47 is configured to control the leg rest actuating device 21 and the body support member actuating device 23. In particular, the control system 47 is thereby able to control the leg rest pivot angle $\alpha$ and the body support member angle $\beta$. The control system 47 is able to control the leg rest actuating device 21 and the body support member actuating device 23 simultaneously if so required, e.g. to set the mobility device 1 in one of various positions that the mobility device 1 is capable to obtain. Some examples of these positions are shown in FIGS. 6*a*-6*c*. The control system 47 may be programmed to provide certain restrictions of the number of positions that the mobility device 1 can obtain. For example, in case the mobility device 1 is in the position shown in FIG. 6*b* with the leg rest 15 pushed forward, and the user provides an input to control the body support member actuating device 23 to obtain a full standing position of the mobility device 1 as shown in FIG. 6*c*, the control system 47 may control the leg rest actuating device 21 to be moved towards the main frame 3 for reasons of safety.

Figure 7A:
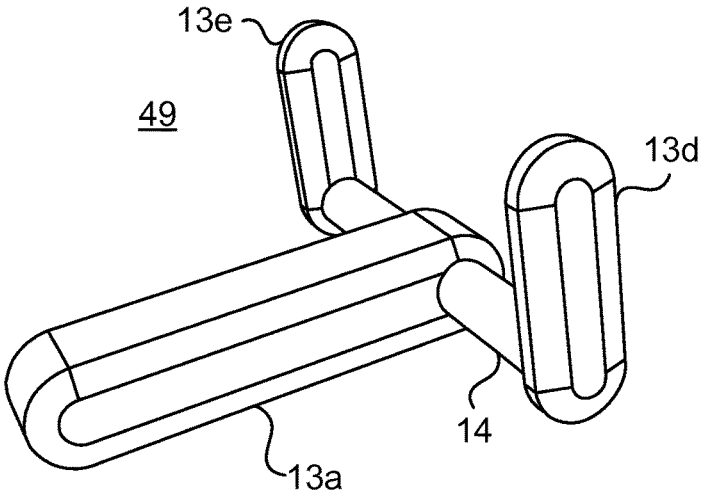
FIGS. 7*a*-7*c* show various perspective views of an example of a median to bilateral power transfer assembly housing.

FIG. 7*a* depicts a median to bilateral power transfer assembly housing 49. The median to bilateral power transfer assembly housing 49 includes the body support member 13*a*, the rotation transfer member housing 14, the first support structure 13*d* and the second support structure 13*e*. These four components form a single rigid housing structure, i.e. the median to bilateral power transfer assembly housing 49. The body support member 13*a*, the rotation transfer member housing 14, the first support structure 13*d* and the second support structure 13*e* are hence fixedly connected relative to each other.

Figure 7B:
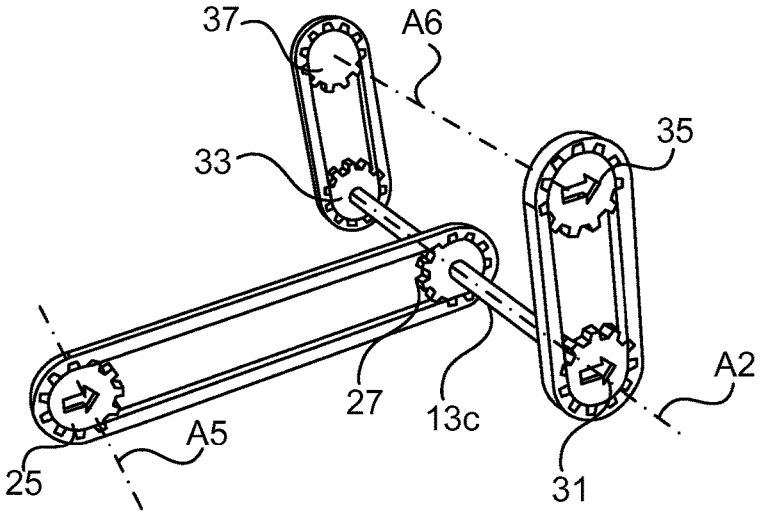

FIG. 7*b* shows the interior of the median to bilateral power transfer assembly housing 49. The median to bilateral power transfer assembly housing 49 comprises the first rotational drive member 25 and the second rotational drive member 27 and their rotational connection, for example by means of a belt or chain. The median to bilateral power transfer assembly housing 49 also comprises the rotation transfer member 13*c*, which is a rotatable shaft, driven by the connection between the first rotational drive member 25 and the second rotational drive member 27. The first lateral motion transfer member 31 and the second lateral motion transfer member 33 are fixedly connected to the rotation transfer member 13*c* and arranged in a respective one of the first support structure 13*d* and the second support structure 13*e*. The first backrest rotational drive member 35 is rotationally connected to the first lateral motion transfer member 31 and arranged in the first support structure 13*d*. The second backrest rotational drive member 37 is rotationally connected to the second lateral motion transfer member 33 and arranged in the second support structure 13*e*.

The arrows in FIG. 7*b* show the rotational position of the first rotational drive member 25 and the corresponding positions of the first lateral motion transfer member 31 and the first backrest rotational drive member 35. The rotational position for all of these components is the same. This also applies to the second lateral motion transfer member 33 and the second backrest rotational drive member 37.

Figure 7C:
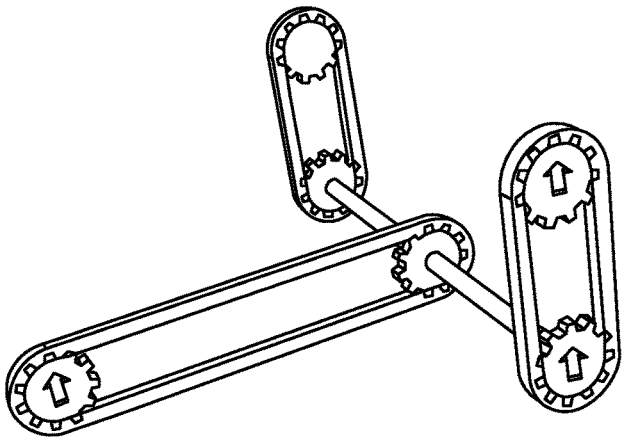

FIG. 7*c* shows that as the first rotational drive member 25 is rotated about a first rotational axis A5, the second rotational drive member 27, the first lateral motion transfer member 31 and the second lateral motion transfer member 33 are rotated with the same amount and in the same direction about a second rotational axis A2, which is the central longitudinal axis of the rotation transfer member 13*c*, offset from the first rotational axis A5, and the first backrest rotational drive member 35 and the second backrest rotational drive member 37 are rotated with the same amount and in the same direction about a third rotational axis A6 offset from the first rotational axis A5 and the second rotational axis A6, as shown by the arrows.

The backrest 13*h* is fixedly arranged relative to the first backrest rotational drive member 35 and the second backrest rotational drive member 37. Hence, as the first backrest rotational drive member 35 and the second backrest rotational drive member 37 are rotated so is the backrest 13*h*. Rotation of the medially located first rotational drive member 25 causes rotation of the backrest 13*h* with the same amount and in the same direction.

Figure 8:
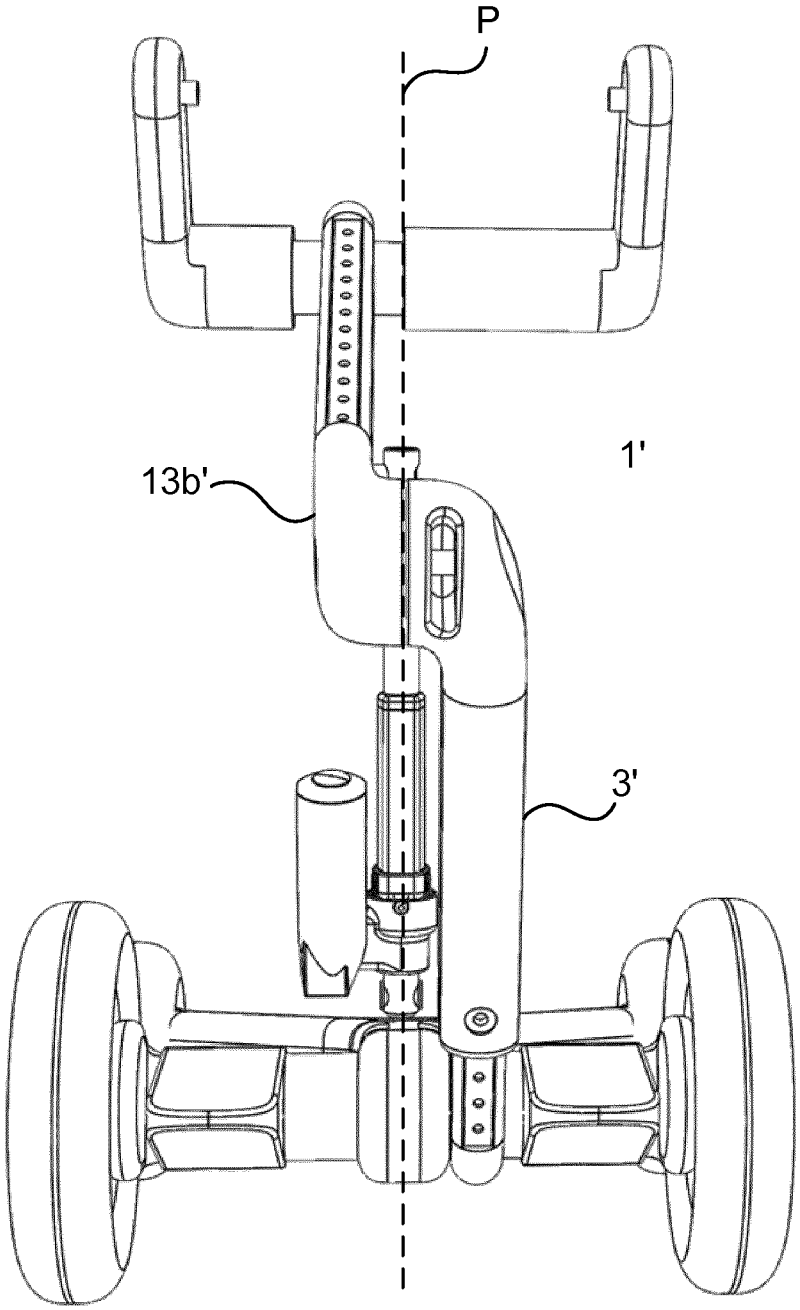
FIG. 8 is a front view of an example of a mobility device with a laterally offset main frame and body support member.

Turning now to FIG. 8, the main frame 3' may according to one example have an elongated shape and may have a central longitudinal axis which is arranged offset from the median plane P of the mobility device. The central longitudinal axis may be arranged in a sagittal plane of the mobility device. According to one example the body support member 13*b*' may have a central longitudinal axis that is arranged parallel with but offset from the median plane P of the mobility device 1'. Both offsets may be slight, enabling the user to place each leg on a respective lateral side of the body support member 13*b*' and the feet on each lateral side of the main frame 3'.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. A mobility device (1) comprising:

a main frame (3) having a central longitudinal axis which coincides with the median plane of the mobility device (1), an elongated body support member (13*b*) which has a central longitudinal axis (A1) that is contained in a median plane of the mobility device (1), the body support member (13*b*) being pivotally connected to the main frame (3) via a medial pivot connection (17), an elongated rotation transfer member (13*c*) configured to rotate relative to the body support member (13*b*), wherein the rotation transfer member (13*c*) has a central longitudinal axis (A2) which extends transversally relative to the central longitudinal axis (A1) of the body support member (13*b*).

2. The mobility device (1) as claimed in claim 1, wherein the body support member (13*b*) and the rotation transfer member (13*c*) have the shape of a T, with the body support member (13*b*) forming the base of the T and the rotation transfer member (13*c*) forming the top of the T.

3. The mobility device (1) as claimed in claim 1, further comprising a first lateral motion transfer member (31; 31') fixedly connected to the rotation transfer member (13*c*) at a first lateral end thereof, and a second lateral motion transfer member (33; 33') fixedly connected to the rotation transfer member (13*c*) at a second lateral end thereof.

4. The mobility device (1) as claimed in claim 3, comprising a backrest (13*h*), an elongated first support structure (13*d*) extending between a first end of the rotation transfer member (13*c*) and the backrest (13*h*), a first backrest rotational drive member (35) interconnected with the first lateral motion transfer member (31) and fixedly connected to the backrest (13*h*), an elongated second support structure (13*e*) extending between a second end of the rotation transfer member (13*c*) and the backrest (13*h*), and a second backrest rotational drive member (37) interconnected with the second lateral motion transfer member (33) and fixedly connected to the backrest (13*h*), wherein rotation of the rotation transfer member (13*c*) causes the first lateral motion transfer member (31), the first backrest rotational drive member (35) to rotate, the second lateral motion transfer member (33) to rotate, and the second backrest rotational drive member (37) to rotate, thereby rotating the backrest (13*h*).

5. The mobility device (1) as claimed in claim 4, wherein the first support structure (13*d*) is configured to space apart the first backrest rotational drive member (35) and the first lateral motion transfer member (31; 31'), and the second support structure (13*e*) is configured to space apart the second backrest rotational drive member (37) and the second lateral motion transfer member (33; 33').

6. The mobility device (1) as claimed in claim 3, further comprising a leg rest (15) pivotally connected to the main frame (3) via said medial pivot connection (17) wherein the rotation transfer member (13*c*) has a rotation transfer connection with the leg rest (15), whereby rotational motion of the leg rest (15) relative to the main frame (3) causes rotation of the rotation transfer member (13*c*) providing corresponding rotational motion of the first lateral motion transfer member (31; 31') and the second lateral motion transfer member (33; 33').

7. The mobility device (1) as claimed in claim 6, comprising a leg rest actuating device (21) configured to control a leg rest pivot angle ($\alpha$) between the leg rest (15) and the main frame (3).

8. The mobility device (1) as claimed in claim 6, wherein the leg rest (15) and the rotation transfer member (13*c*) form part of a symmetric rotation transfer assembly.

9. The mobility device (1) as claimed in claim 6, further comprising a first rotational drive member (25) fixedly connected to leg rest (15).

10. The mobility device (1) as claimed in claim 6, further comprising a second rotational drive member (27) fixedly connected to the rotation transfer member (13*c*).

11. The mobility device (1) as claimed in claim 9, wherein the first lateral motion transfer member (31) is a third rotational drive member and the second lateral motion transfer member (33) is a fourth rotational drive member.

12. The mobility device (1) as claimed in claim 11, comprising a belt system or a chain system interconnecting the first rotational drive member (31), the second rotational drive member (33), the third rotational drive member and the fourth rotational drive member to enable rotational motion transfer from the leg rest (15) to the third rotational drive member and to the second fourth rotational drive member.

13. The mobility device (1) as claimed in claim 6, further comprising a linkage system (30) interconnecting the leg rest (15), the rotation transfer member (13*c*), the first lateral motion transfer member (31') and the second lateral motion transfer member (33') to enable rotational motion transfer from the leg rest (15) to the first lateral motion transfer member (31') and to the second lateral motion transfer member (33').

14. The mobility device (1) as claimed in claim 7, further comprising a body support member actuating device (23) pivotally connected to the main frame (3) and to the body support member (13*b*), wherein the body support member actuating device (23) is configured to control a body support member angle (β) between the body support member (13*b*) and the main frame (3).

15. The mobility device (1) as claimed in claim 14, further comprising a control system (47) configured to simultaneously control the leg rest actuating device (21) and the body support member actuating device (23).

16. The mobility device (1) as claimed in claim 1, further comprising:

drive swing arms (5) pivotally connected to the main frame (3), wheel motors, and drive wheels (7), each drive wheel (7) being connected to a respective one of the drive swing arms (5) and each drive wheel (7) being configured to be driven by a respective wheel motor.

17. The mobility device (1) as claimed in claim 16, comprising:

a rear wheel swing arm (9) pivotally connected to the main frame (3), a rear wheel (11) connected to the rear wheel swing arm (9), and a rear wheel swing arm actuating device configured to control a rear wheel swing arm angle between the rear wheel swing arm (9) and the main frame (3) independently of control of the wheel motors.

18. The mobility device (1) as claimed in claim 1, wherein the mobility device (1) is a wheelchair or a personal transporter.

19. The mobility device (1) as claimed in claim 1, further comprising a body support member actuating device (23) pivotally connected to the main frame (3) and to the body support member (13*b*), wherein the body support member actuating device (23) is configured to control a body support member angle (β) between the body support member (13*b*) and the main frame (3).

* * * * *